US005563695A

United States Patent [19]

Sakurai et al.

[11] Patent Number: 5,563,695

[45] Date of Patent: Oct. 8, 1996

[54] IMAGE FORMING APPARATUS FOR PREVENTING RELEASE AGENT FROM BEING ADHERED ONTO IMAGE CARRIER

[75] Inventors: Masaaki Sakurai, Yokohama; Tatsuo Takeuchi, Kawasaki; Masahiro Inoue, Yokohama; Jiro Ishizuka, Machida, all of Japan

[73] Assignee: Canon Kabushiki Kaisha, Tokyo, Japan

[21] Appl. No.: 447,445

[22] Filed: May 23, 1995

Related U.S. Application Data

[63] Continuation of Ser. No. 127,605, Sep. 28, 1993, abandoned.

[30] Foreign Application Priority Data

Sep. 30, 1992 [JP] Japan ..... 4-261833

[51] Int. Cl.[6] ..... G03G 15/20; G03G 21/00

[52] U.S. Cl. ..... 355/283; 118/60; 118/DIG. 1; 355/284; 355/311; 355/319

[58] Field of Search ..... 355/282, 284, 355/309, 311, 319, 283; 118/60, DIG. 1

[56] References Cited

U.S. PATENT DOCUMENTS

| | | | |
|---|---|---|---|
| 4,568,275 | 2/1986 | Sakurai | 432/60 |
| 4,593,992 | 6/1986 | Yoshinaga et al. | 219/216 X |
| 4,942,433 | 7/1990 | Stuart | 355/284 |
| 5,049,943 | 9/1991 | Menjo et al. | 355/284 |
| 5,132,739 | 7/1992 | Mauer et al. | 355/284 |
| 5,160,970 | 11/1992 | Isogai | 355/284 |

FOREIGN PATENT DOCUMENTS

| | | | |
|---|---|---|---|
| 1-106086 | 4/1989 | Japan | 355/284 |
| 3-282577 | 12/1991 | Japan | 355/284 |
| 4-318584 | 11/1992 | Japan | 355/284 |
| 4-318585 | 11/1992 | Japan | 355/284 |
| 5-27637 | 2/1993 | Japan | 355/284 |

*Primary Examiner*—William J. Royer

*Attorney, Agent, or Firm*—Fitzpatrick, Cella, Harper & Scinto

[57] ABSTRACT

An image formation apparatus is disclosed, capable of forming an image on both surfaces of a recording medium. The image formation apparatus is provided with the latent image forming unit for forming an unfixed image on the photosensitive drum, the transfer drum for transferring the unfixed image onto the recording medium, and an oil application device for applying a release agent onto the fixing roller. The release agent applied upon fixing the first surface is different in quantity from that applied upon fixing the second surface and the releasing agent applied to the fixing rotor during single side fixing is different in quantity than when both surfaces are to be fixed. The releasing agent quantity also differs depending on whether the apparatus is in cassette feed mode or manual feed mode and is not applied when the recording medium is in contact with the fixing roller.

12 Claims, 16 Drawing Sheets

IMAGE FORMING APPARATUS FOR PREVENTING RELEASE AGENT FROM BEING ADHERED ONTO IMAGE CARRIER

This application is a continuation of application Ser. No. 08/127,605, filed Sep. 28, 1993, now abandoned.

BACKGROUND OF THE INVENTION

1. Field of the Invention

The present invention relates to an image forming apparatus having a fixing rotor for fixing onto a recording medium while carrying it therebetween, and application means for applying a release agent onto the fixing rotor.

2. Related Background Art

Conventionally, it has been widely practiced in image forming apparatuses such as an electrophotographic apparatus or an electrostatic recording apparatus that an unfixed toner image is fixed by a heat roller fixing device.

It is the common practice that a release agent is applied onto the heat roller in the heat roller fixing device to prevent offset of toner.

FIG. 1 illustrates an example of an image forming apparatus having a heat roller fixing unit. This example is a full-color image forming apparatus of electrophotographic type.

A color electrophotographic apparatus as illustrated in FIG. 1 includes a transfer medium conveyance system I provided from the right side of apparatus main body 1 (as seen in FIG. 1) to the substantially central portion thereof, a latent image forming unit II provided in the substantially central portion of apparatus main body 1 in proximity to a transfer drum 15 constituting the transfer medium conveyance system I, and developing means disposed in proximity to the latent image forming unit II, namely, a rotary developing unit III.

The transfer medium conveyance system has a constitution as described below. First, an opening is formed on a right wall of the apparatus main body 1 (as seen in FIG. 1), and detachable transfer medium supply trays 2, 3 are disposed in the opening, part of the trays projecting from the apparatus. Sheet supply rollers 4, 5 are arranged substantially just above the trays 2, 3. Sheet feed rollers 6 and sheet supply guides 7, 8 are provided so as to communicate from the sheet supply rollers 4, 5 to a transfer drum 15 that is transfer means disposed leftward and rotatable in a direction of the arrow A. Around the external curved surface of the transfer drum 15 are disposed successively an abutting roller 9, a gripper 10, a transfer medium separation electrostatic charger 11, and a separation claw 12, from the upstream side in a rotational direction of the drum 15 to the downstream side. Also, on the inner side of the transfer drum 15 are disposed a transfer electrostatic charger 13 and a transfer medium separation electrostatic charger 14. The transfer drum has a transfer sheet (not shown) composed of polyvinylidene fluoride adhered on a portion of the transfer drum around which the transfer medium is wound, so that the transfer medium is electrostatically adhered intimately onto the transfer sheet. Conveying belt means 16 is disposed right upward of the transfer drum 15 and in proximity to the separation claw 12, and a fixing unit 18 is disposed in the terminal (right) end portion of the conveying belt means 16 in a direction of conveying the transfer medium. An exhaust tray 17 extending from the apparatus main body 1 and detachable therefrom is disposed further downward of the fixing unit 18 in the conveying direction.

Next, the constitution of latent image forming unit II will be described below. First, a photosensitive drum 19 which is a latent image carrier and is rotatable in a direction of the arrow B in FIG. 1, is disposed with its external curved surface contacting the external curved surface of the transfer drum 15. Around the external curved surface of the photosensitive drum 19 are disposed successively a static eliminator 20, cleaning means 21 and a primary electrostatic charger 23, from the upstream side in a rotational direction of the photosensitive drum 19 to the downstream side. Further, image exposure means 24 such as a laser beam scanner for forming an electrostatic latent image and image exposure reflecting means 25 such as a mirror are arranged upward of the external curved surface of the photosensitive drum 19.

Finally, the constitution of rotary developing device III is as follows. A rotatable housing 26 (hereinafter referred to as a "rotor") is disposed opposed to the external curved surface of the photosensitive drum 19, including four types of developing units mounted at four positions along a circumferential direction thereof to visualize (or develop) an electrostatic latent image formed on the external curved surface of the photosensitive drum 19. The above four types of developing units involve a yellow developing unit 27Y, a magenta developing unit 27M, a cyan developing unit 27C and a black developing unit 27Bk.

The overall sequence of the image forming apparatus having the above constitution will be first described briefly in an instance of full-color mode. If the photosensitive drum 19 is rotated in a direction of the arrow B in FIG. 1, a photosensitive member on the photosensitive drum 19 is evenly charged by the primary electrostatic charger 23. The apparatus of FIG. 1 has an operation speed (hereinafter referred to as "process speed") of 160 mm/sec. If the photosensitive member is evenly charged by the primary electrostatic charger 23, an image is exposed to a laser beam E modulated by a yellow image signal of original 28, so that an electrostatic latent image is formed on the photosensitive drum 19 and developed by the yellow developing unit 27Y prepositioned at a developing position by rotation of the rotor 26.

On the other hand, the transfer medium conveyed via the sheet feed guide 7, sheet feed rollers 6 and sheet feed guide 8 is held by the gripper 10 at a predetermined timing, and wound electrostatically around the transfer drum 15 by virtue of the abutting roller 9 and an electrode placed opposite to the abutting roller 9. The transfer drum 15 is rotated in synchronism with the photosensitive drum 19 in a direction of the arrow A in FIG. 1, visible image developed by the yellow developing unit 27Y is transferred by transfer electrostatic charger 13 at a position where the external curved surface of the photosensitive drum 19 and the external curved surface of the transfer drum 15 are in contact with each other. The transfer drum 15 is continuously rotated, and placed in a ready state for the transfer of the next color (magenta in FIG. 1).

On the other hand, the photosensitive drum 19 has its static charges eliminated by the static eliminator 20, and is cleaned by cleaning means 21 relying on a conventionally well-known blade method, thereafter, is charged again by the primary electrostatic charger 23, and subjected to image exposure as described above upon accepting a next magenta image signal. The above rotary developing device is rotated while an electrostatic latent image with the magenta image signal is being formed on the photosensitive drum 19 by image exposure, so that the magenta developing unit 27M is positioned at the developing position predetermined as above for effecting a predetermined magenta development. Subsequently, the same process as described above is performed for each color of cyan and black. When the transfer of four colors is completed, the transfer medium has a four-color visible image formed thereon. Then, the transfer medium is static eliminated by the eliminator 20 and the charger 14, released from the gripping with the gripper 10, separated from the transfer drum 15 by virtue of the separation claw 12, conveyed to the fixing unit 18 on the conveying belt 16, and fixed by heat and pressure, whereby a full-color print sequence is ended to form a desired full-color print image.

Then, the fixing operation of the fixing unit 18 is performed at a speed slower than a main process speed of 160 mm/sec, or at 90 mm/sec. This is because a sufficient amount of heat must be given to the toner when the unfixed image having two to four toner layers laminated is fused and color mixed, as will be described later, wherein the fixing speed slower than the main speed will provide a greater amount of heat to the toner.

The fixing unit 18 has a fixing roller 29, a pressure roller 30 for pressing on the fixing roller 29, and oil application means 0 for applying silicone oil to the fixing roller 29.

In such full-color image forming apparatus, the amount of applying silicone oil is large because toner has the great affinity and is liable to be offset.

The apparatus as illustrated in FIG. 1 is involved in image formation only on the single surface of the transfer medium, therefore, the transfer medium once having passed through the fixing unit is not supplied again.

However, if the transfer medium is supplied again for copying on both surfaces, the toner face (i.e., face on which oil is applied) will be placed on the transfer drum 15. Accordingly, the transfer medium is wound around the transfer drum 15, thus oil applied on the toner or transfer medium will be transferred onto the transfer sheet, thereafter, the oil on the transfer drum will be transferred onto the photosensitive drum 19 by rotation of the transfer drum 15 from which the transfer medium has been separated.

In this way, if the oil is transferred onto the photosensitive drum 19, the toner can not be cleaned away even by cleaning means 21 on the photosensitive drum 19, or the toner may adhere onto the oil at other portions than a desired latent image formed portion, resulting in the problem that subsequent copies may produce contaminated images with excess toner attached thereto. Owing to the oil attached onto the recording medium, the conveying force of the sheet supply roller 50 will decrease, also a sheet supply failure will occur. This phenomenon is particularly remarkable when the portion in contact with the sheet supply roller is a solid image.

Also, in the both-surface color copying, the recording medium is liable to produce wrinkles in the fixing process for the second surface.

The liability of producing wrinkles in the fixing process of the second surface is greatly dependent on the first side image, and is particularly significant when the first side image is a solid image (or a near solid image on which a great amount of toner is attached) on the central portion thereof and no image (or an image on which a small amount of toner is attached) on the peripheral portion as shown in FIGS. 5A and 5B. This is because when the recording medium is heated in the fixing process of the first side, there will occur distortion due to difference in amounts of shrinkage between the solid image portion on which a great amount of toner is attached and the white portion, and then the distortion will appear as wrinkles in the fixing process of the second side.

This mechanism will be explained with FIGS. 5A and 5B. When the transfer medium 101 is a paper, the paper will shrink in different amounts depending on the amount of toner if a toner image 102 is formed and fixed in the central portion of this paper, and it takes a convex shape expanding in the central portion as shown in FIG. 5B, if the paper is cut along the axis a—a'. If this paper is formed with another toner image on the opposite surface of this paper to the toner side 102, and passed again through the fixing unit in a direction normal to the drawing, the paper passing width is restricted, with the height in the convex portion of this paper not being relieved, because the portions C and C' having no toner image are tightly carried and fed between the sticky roller faces. Therefore, if this phenomenon takes place on the longitudinally extending paper such as A3, possibly having a slight convex, paper wrinkles will arise.

SUMMARY OF THE INVENTION

An object of the present invention is to provide an image forming apparatus wherein a release agent is prevented from being attached onto the image carrier.

It is another object of the present invention to provide an image forming apparatus capable of forming a full-color image on both surfaces of recording medium.

It is a further object of the present invention to provide an image forming apparatus including image forming means for forming an unfixed image on an image carrier, a transfer rotor rotating with a recording medium carried thereon for transferring the unfixed image on the image carrier to the recording medium, a fixing rotor for fixing the unfixed image onto the recording medium at least under the application of pressure, and application means for applying a release agent onto the fixing rotor, wherein the release agent applied by the applying means upon fixing of the first surface is different in quantity or kind from that upon fixing of the second surface.

It is a still further object of the present invention to provide an image forming apparatus including cassette sheet supply means for supplying a recording medium from a cassette, manual insertion sheet supply means for supplying the recording medium by manual insertion, image forming means for forming an unfixed image on the recording medium supplied thereto, a fixing rotor for fixing the unfixed image on the recording medium at least under the application of pressure, and application means for applying a release agent onto the fixing rotor, wherein the release agent applied by the application means in the cassette sheet supply mode is different in quantity or kind from that in the manual insertion sheet supply mode.

It is another object of the present invention to provide an image forming apparatus including image forming means for forming an unfixed image on a recording medium, a fixing rotor for fixing the unfixed image on the recording medium at least under the application of pressure, and application means for applying a release agent onto the fixing rotor, wherein the application means applies the release agent over one or more rotations except for the timing at which the fixing rotor makes contact with the recording medium.

Other objects of the present invention will be clear from the following description.

DESCRIPTION OF THE PREFERRED EMBODIMENTS

The preferred embodiments of the present invention will be described below.

Figure 1:
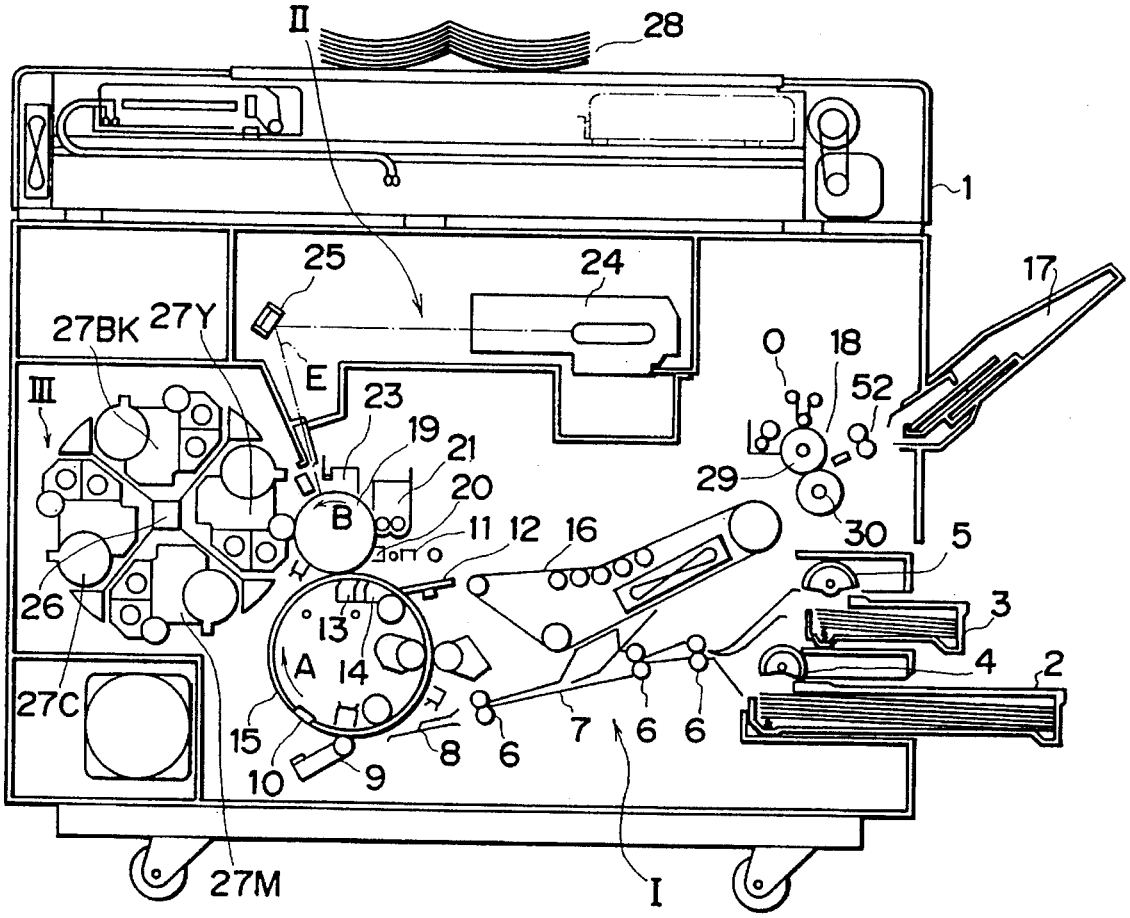
FIG. 1 PRIOR ART
FIG. 1 is a cross-sectional view of a conventional image forming apparatus.
Figure 4:
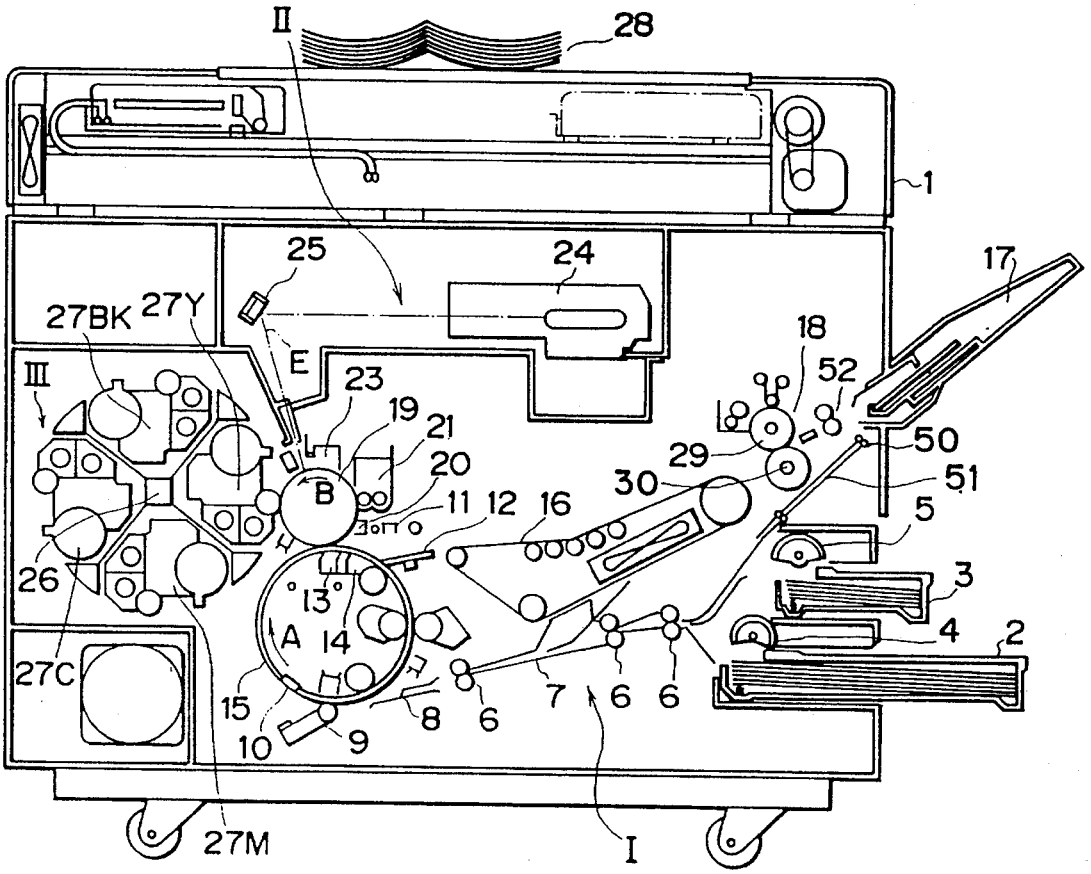
FIG. 4 is a cross-sectional view of an image forming apparatus in the embodiment of the present invention.
Figure 5A:
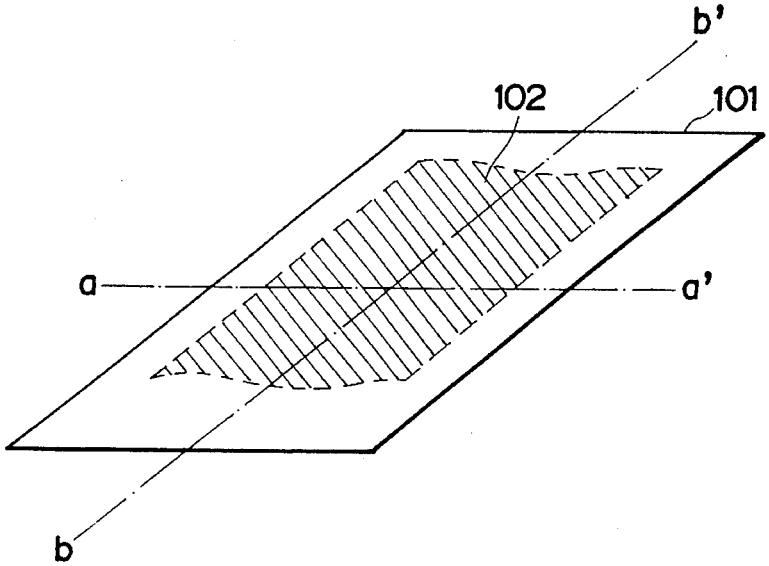
FIG. 5A PRIOR ART
FIGS. 5A and 5B are perspective and cross-sectional views for explaining the occurrence of a wrinkle on the recording medium, respectively.
Figure 5B:
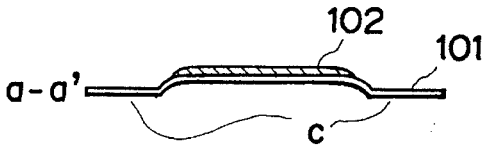
FIG. 5B PRIOR ART

FIG. 4 is a cross-sectional view of a full-color image forming apparatus according to an embodiment of the present invention. The description of the parts of the apparatus equivalent to those as illustrated in FIG. 1 will be omitted.

First, a toner for use in this apparatus will be described.

Since this toner is required to have good meltability and color mixing ability under the application of heat, a sharp melt toner is used, which has a low softening point and a low melt viscosity. The use of such sharp melt toner will extend the color reproduction range in the copy, and provide for the color copy faithful to a multi-color or full-color image of the original.

Such sharp melt toner is manufactured by melting, kneading, grinding and classifying a toner forming material such as a binding resin such as polyester resin or styreneacrylic ester resin, a coloring agent (dye, sublimate dye), and a charge control agent. If necessary, an external additive process may be provided for adding a variety of external additive agents (e.g., hydrophobic colloidal silica) to the toner. Such color toner may be most preferably composed of polyester resin as the binding resin in view of fixing ability and sharp melt ability. Examples of sharp melt polyester resin may include high molecular compounds having ester bond in the principal chain of molecule composed of diol compound and dicarboxylic acid.

In particular, polyester resin is more preferable, which at least contains colymerization of a diol component composed of bisphenol derivative (or its substitution product) represented by the following expression:

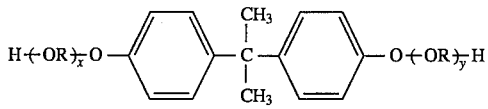

(where R is etylene or propylene radical, x, y is a positive integer equal to or greater than 1, and the average value of x+y is 2 to 10) and a carboxylic acid component (e.g., fumaric acid, maleic acid, maleic anhydride, phthalic acid, terephthalic acid, trimellitic acid, pyromellitic acid) composed of di- or polyhydric carboxylic acid or its acid anhydride or lower alkylester, owing to its sharp melt characteristic.

The softening point of polyester resin ranges from 75° to 150° C., and preferably from 80° to 120° C.

Figure 2:
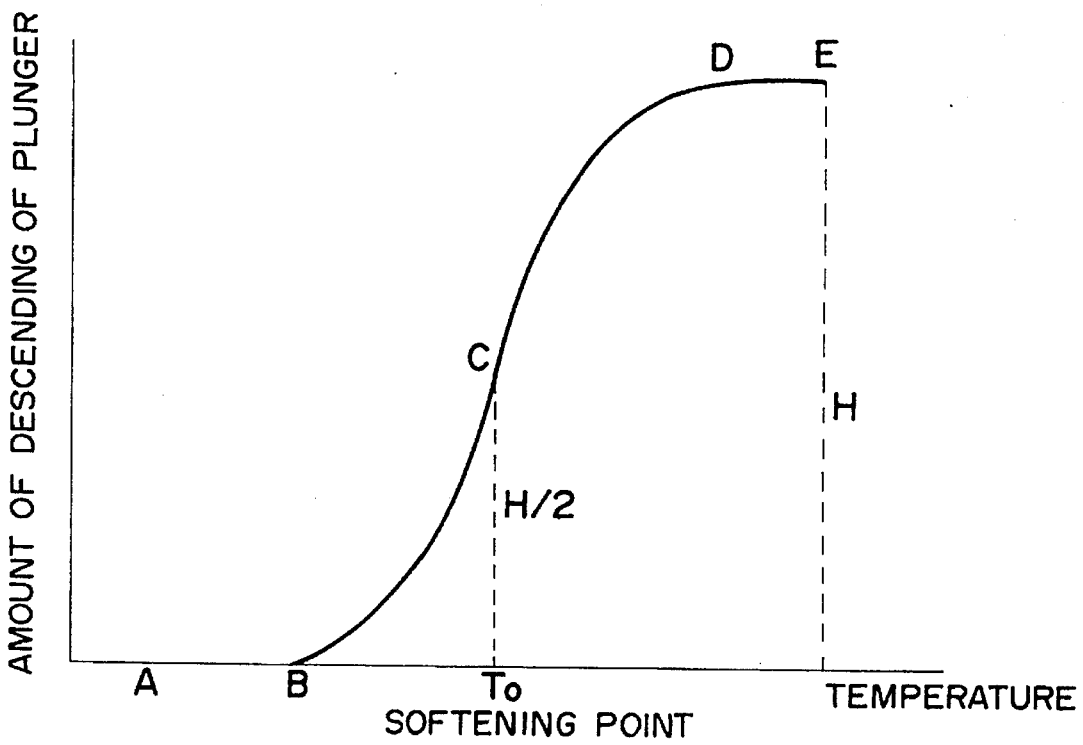
FIG. 2 is an explanation view of a toner for use in an embodiment of the present invention.

An example of the softening characteristic of a sharp melt toner containing this polyester resin as the binding resin is shown in FIG. 2. The measurement conditions are as follows.

The amount of descending of a plunger vs. temperature curve of toner (hereinafter referred as a softening S curve) was obtained. The softening S curve was drawn when temperature was elevated at a constant rate of 6° C./min with an initial set temperature of 70° C., after a preheating time of 300 sec, using a flow tester CFT-500A type (made by Shimadzu Corp.) with a dye (nozzle) having a diameter of 0.2 mm and a thickness of 1.0 mm, to which an extrusion load of 20 kg was applied. Fine grains of 1 to 3 g accurately weighted was used as sample toner. The cross-sectional area of plunger was 1.0 $cm^2$. The softening S curve is as shown in FIG. 2. When the temperature is elevated at constant rate, the toner is gradually heated to start to flow out (plunger descending A→B). If the temperature is further elevated, the toner in melt state will flow out greatly (B→C→D), so that the plunger descending is stopped (D→E) and ended.

The height H of the S curve indicates the total flow amount, and the temperature T0 corresponding to a C point as high as H/2 indicates the softening point of toner.

It is judged by measuring the apparent melt viscosity of the toner or the binding resin whether or not the toner or the binding resin has a sharp melt property.

The toner or binding resin having such sharp melt property means those satisfying the conditions:

T1=90° to 150° C.

$|\Delta T|=|T1-T2|=5°$ to 20° C.

where T1 is a temperature at which the melt viscosity of $10^3$ poise is indicated and T2 is a temperature at which the melt viscosity of $5\times10^2$ is indicated.

The sharp melt resins having such temperature vs. melt viscosity characteristic are characterized in that the viscosity may be reduced quite sharply by heating. Such reduction of viscosity will bring about adequate mixture of a top toner layer and a bottom toner layer, further rapidly increasing the transparency of toner layer itself to produce excellent substrative color mixture.

Such sharp melt color toners have further a property of being easily offset on the fixing roller owing to great affinity.

Figure 3:
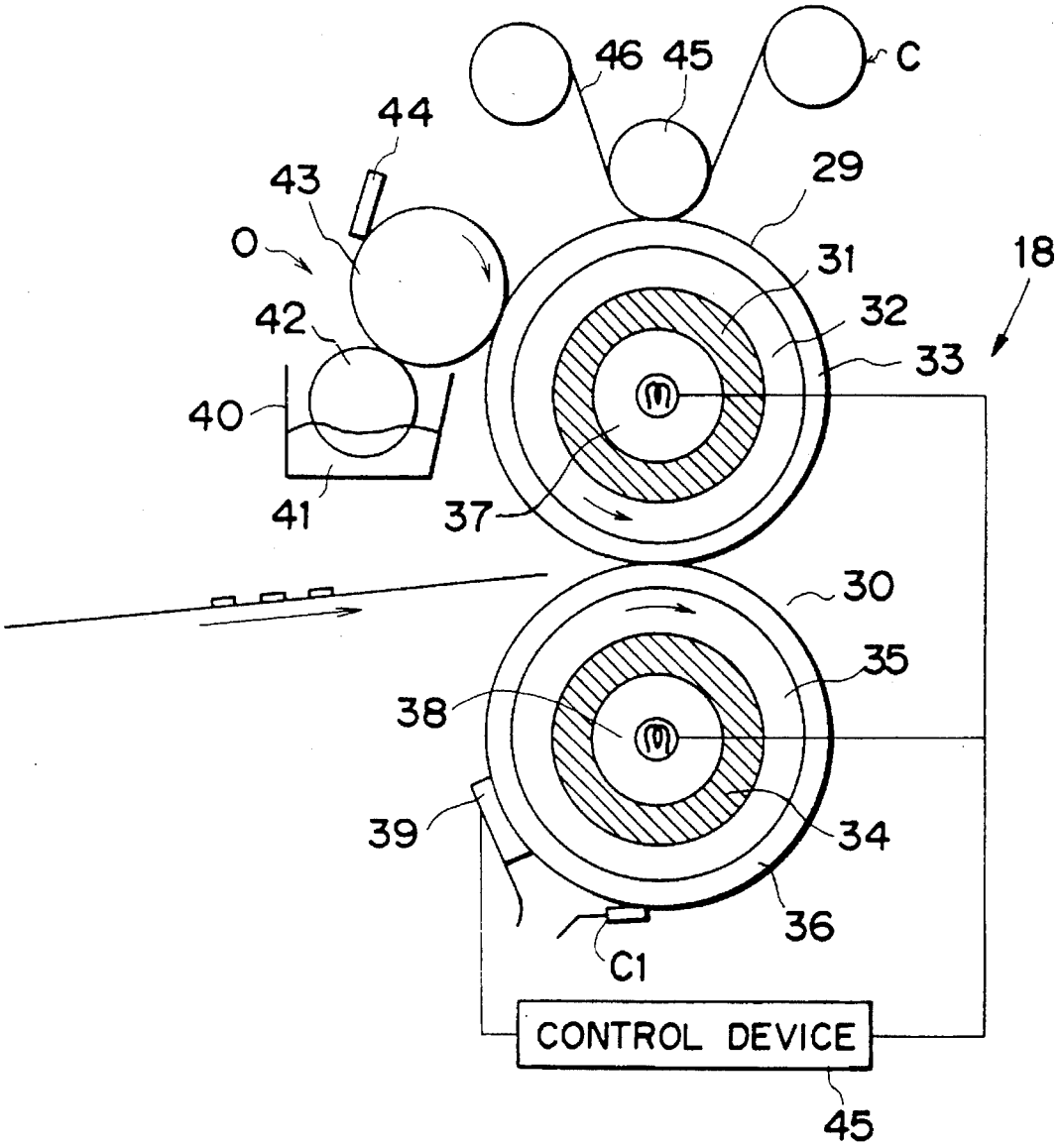
FIG. 3 is a cross-sectional view of a fixing unit for use in the embodiment of the present invention.

FIG. 3 illustrates an enlarged cross-sectional view of fixing unit 18.

In FIG. 3, a fixing roller 29 that is a fixing rotation member has, on a core bar made of aluminum 31, a silicone rubber layer 32 of HTV (high temperature vulcanization type) having a thickness of 2 mm and a silicone rubber layer 33 of RTV (room temperature vulcanization type) having a thickness of 200 μm provided externally thereof, and is formed in a diameter of 40 mm.

A pressure roller 30 that is likewise a fixing rotation member has, on a core bar 34 of aluminum, an HTV silicone rubber layer 35 having a thickness of 1 mm, and an RTV silicone rubber layer 36 having a thickness of 200 μm thereon, and is formed in a diameter of 40 mm.

The fixing roller 29 has a halogen heater 37 as heating means, and the pressure roller 30 has a heater 38 within the core bar to thereby effect heating from both sides. The temperature of the pressure roller 30 is sensed by a thermistor 39 placed in contact with the pressure roller 30, and halogen heaters 37, 38 are controlled by a control device 45, based on this sensed temperature, so that the temperature of the fixing roller 29 and the temperature of pressure roller 30 are both held at a constant temperature of about 170° C. The fixing roller 29 and the pressure roller 30 are pressed at a total pressure of about 40 kg by a pressing mechanism (not shown).

Also, in FIG. 3, O is an oil application unit that is release agent application means, C is a cleaning unit, and C1 is a cleaning blade for removing the oil and dirt of the pressure roller. The oil application unit O applies dimethyl silicone oil 41 (KF96 300 cs made by Shinetsu Chemical) within an oil pan 40 via an oil drawing roller 42 and an oil application roller 43 onto the fixing roller 29, while the oil application amount is regulated by an oil application amount regulating blade 44. The unit shown in FIG. 3 applies an amount of 0.02 g/A4 as measured by a measurement method as will be described later.

The amount of application of silicone oil by the oil application unit O can be obtained as follows.

First, it is assumed that the weight of 50 sheets of white paper of A4 size is A1 (g), and the weight of 50 sheets of white paper after having passed between the fixing roller and the pressure roller without any transfer of image onto the white paper and without application of silicone oil on the rubber layers of the fixing roller is B (g). Next, likewise, the weight of 50 sheets of another white paper of A4 size is A2 (g) , and the weight of 50 sheets of white paper after having passed between the fixing roller and the pressure roller without any transfer of image onto the white paper but with application of silicone oil on the rubber layers of the fixing roller is C (g) . The application amount X (g) of silicone oil per sheet of white paper, if using the above-mentioned A1, B, A2, and C, can be obtained by the following expression.

$$X=(C+A1-B-A2)/50$$

On the other hand, cleaning unit C performs cleaning by forcing a web 46 plated with nickel to contain metallic particles in a non-woven fabric composed of Nomex (trade name) to be pressed against the fixing roller 29 by presser roller 45. Also, the web 46 is adequately taken up by a winder (not shown) so that any toner may not deposit on a contact portion.

This embodiment allows for the image formation on both surfaces of a transfer medium that is a recording medium.

This apparatus is provided with a sheet resupply roller 50 and a conveyance passageway 51 which constitute a conveying mechanism for the image formation on both surfaces.

Beneath a sheet exhaust roller 52, the sheet resupply roller 50 is disposed for supplying again the transfer medium once laid on the sheet exhaust tray 17 to the latent image forming unit II, and the conveyance passageway 51 for conveying the transfer medium extends backward from the sheet resupply roller 50.

The operation of copying color image on both surfaces in this apparatus above constituted will be described below.

The transfer medium developed in the developing device III and carrying an unfixed toner image on its surface is conveyed by conveying belt means 16, and fixed by the fixing roller 29 and the pressure roller 30, then fed to the sheet exhaust tray 17 by the sheet exhaust roller 52. Thereafter, the transfer medium is supplied again by the sheet resupply roller 50 to pass through the conveying passageway 51, and again conveyed to the latent image forming unit II to form a color image on the back surface, in the same way as on the front surface. Thus, the transfer medium having already fixed a color image formed on the front surface, and carrying an unfixed color toner image transferred on the back surface, is conveyed by conveying belt means 16 up to the fixing roller 29 as well as the pressure roller 30 to effect fixing, and finally conveyed on to the sheet exhaust tray 17, whereby both-face color copying is completed.

Figure 6:
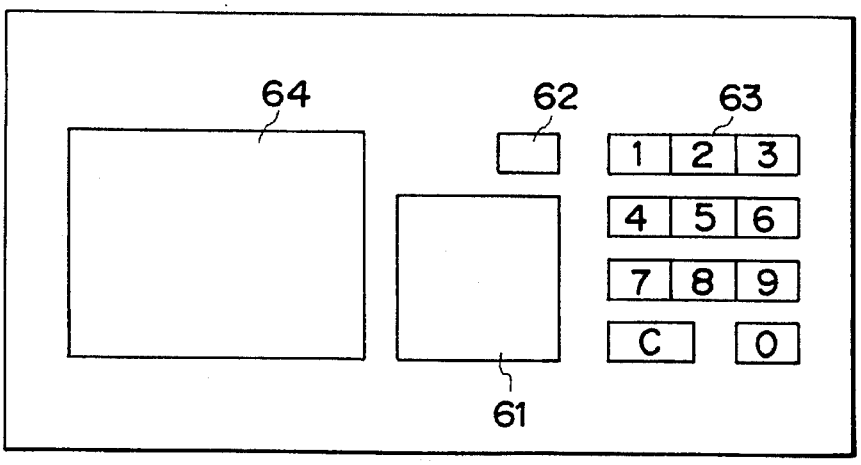
FIG. 6 is a plan view of an operation panel.

FIG. 6 simply illustrates a necessary portion on the operation panel.

Figure 7:
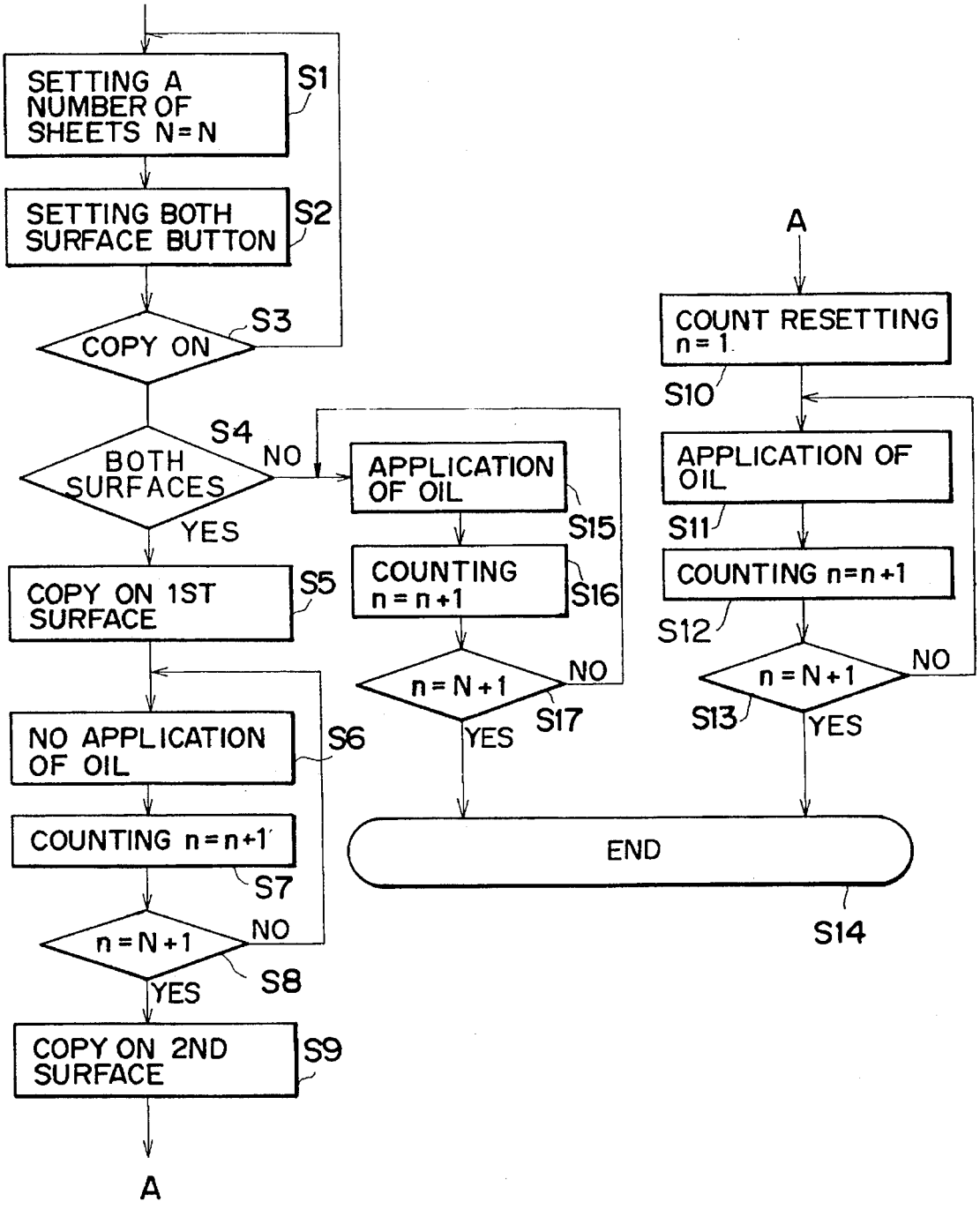
FIG. 7 is a flowchart of the embodiment of the present invention.

In FIG. 6, reference numeral 61 represents a copy button, reference numeral 62 represents a both-face button, reference numeral 63 represents a sheet number setting button, and reference numeral 64 represents a liquid crystal display. FIG. 7 illustrates a flowchart showing the gist of the present invention. First, the number of sheets necessary to be copied is set by the sheet number setting button 63 (S1), the both-face button 62 is set (S2), and if the copy button 61 is depressed (S3), and the copy on the first surface is started (S5). The copy sheet (recording medium) is passed through the same process as previously described (for the full-color copy, the toner image of four colors Y, M, C and Bk is transferred onto the copy sheet), and then carried and conveyed between a pair of fixing rollers 29, 30 to be exhausted on to the sheet exhaust tray. In this case, the oil application unit O is separated away from the fixing roller 29 by a separation mechanism (not shown) at least while the fixing roller 29 is in contact with the copy sheet.

Then, the above process is repeated by counting the number (S7), until the set number is reached.

In this embodiment, the oil application unit is always separated away from the fixing roller 29 during the above period. Taking into consideration the life of fixing roller and the safety for offset, it is more preferable that the oil is supplied by the oil application unit O which is brought into contact with the fixing roller 29 over one rotation of the fixing roller at a timing when the fixing roller 29 is in no contact with the recording medium during the copying.

It is most preferable that the contact timing may take place every time immediately after the copy sheet is exhausted from a nip between the pair of fixing rollers 29, 30. In this case, the oil supplied onto the fixing roller is gradually rendered uniform by rotations of the pair of rollers, a part thereof being immersed into silicone rubber on the surface layer of the pair of fixing rollers, and the other part being cleaned by a cleaning web, together with the toner offset by negligible amount on the fixing roller 29 in the previous fixing of the copy sheet, and removed from the surface of the fixing roller 29. Hence, when fixing onto the next copy sheet, almost no transfer of oil will take place onto the copy sheet, resulting in excellent copying.

The releasing ability can be secured by virtue of the oil immersed in silicone rubber. However, the timing of contact is not limited to the above, but it is needless to say that the application may be effectively made at another timing. If the copy for the necessary number of sheets is completed, a message, "Copy on second surface (or back side copy) will start. Exchange original", appears on the liquid crystal display 64, and upon depressing the copy button 61 again, the copy on second surface is started (S9).

The copy sheet with its first surface copied lying on the sheet exhaust tray is supplied again by the sheet supply roller 50, passed through the same process as described above, carried and conveyed between the pair of fixing rollers 29, 30, and exhausted to the sheet exhaust roller. In this case, while the copy sheet exists at least between the pair of fixing rollers 29, 30, the oil application unit O is placed in contact with the fixing roller 29 (by separation mechanism not shown) (S11).

Next, the above process is repeated by counting the number (S12), until the set number of sheets is reached. And upon reaching a predetermined number of sheets, the copy operation is ended.

In the one-side copy where the both-face button is not depressed, the oil application unit O is placed in contact with the fixing roller 29 (S15) while the copy sheet exists at least between the pair of fixing rollers 29, 30.

According to this embodiment, even if an image is formed on both surfaces of recording medium, it is possible to form high quality image over the long term without causing degradation of image due to release agent and producing any wrinkles.

(Embodiment 2)

Figure 8:
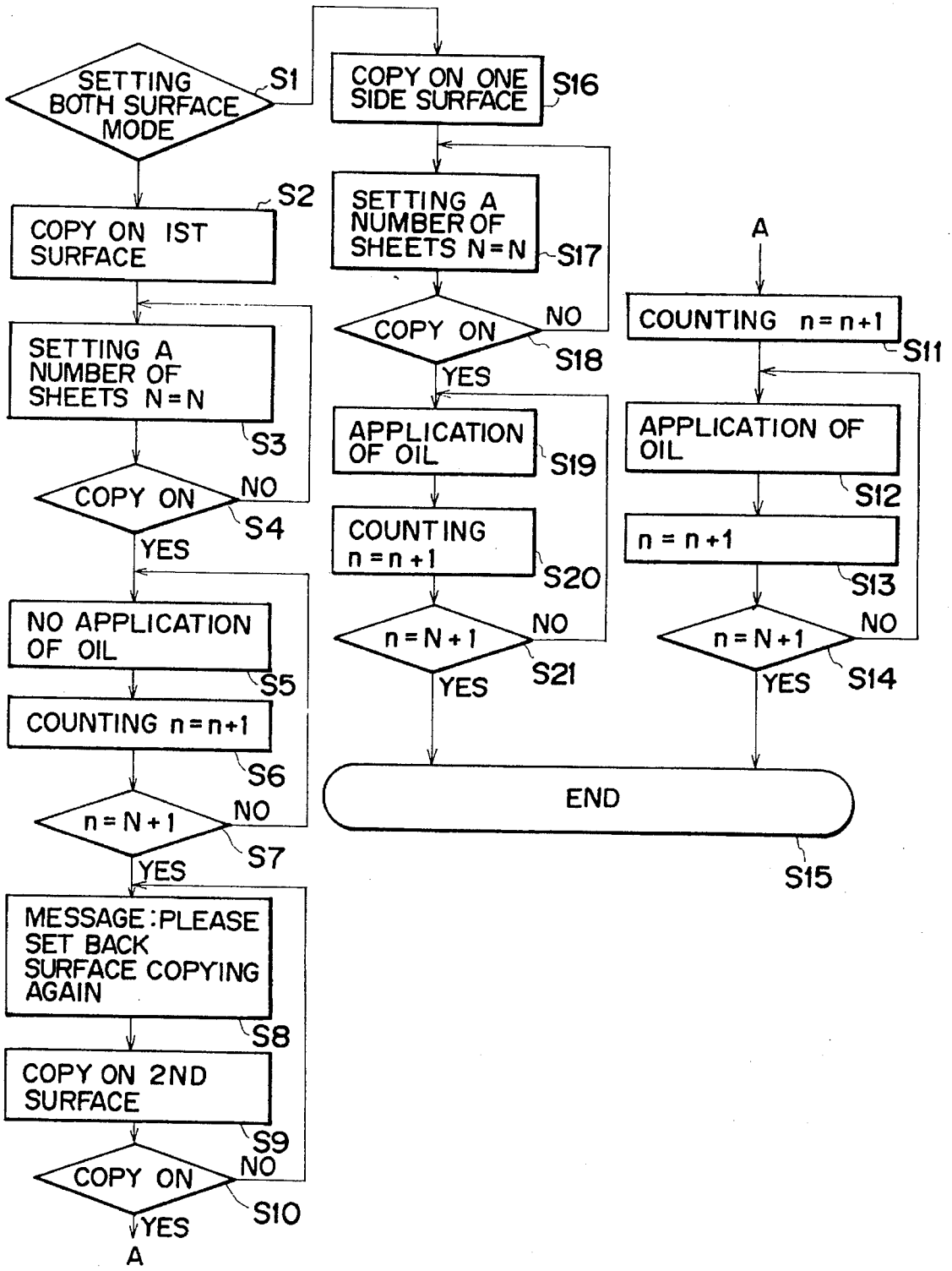
FIG. 8 is a flowchart of another embodiment of the present invention.

A second embodiment of the present invention is illustrated in a flowchart of FIG. 8.

This apparatus has a cross-sectional configuration as shown in FIG. 1, and an operation panel as shown in FIG. 6.

If a both-face button 62 is depressed, a message "Copy on first surface. Set number of sheets" appears on a liquid crystal display 64 (S2), the necessary number of sheets to be copied is set (S3), and if a copy button 61 is depressed (S4), the copy on the first surface is started. Copy sheet on which a full-color image is formed through the same process as previously described is carried and conveyed between the pair of fixing rollers 29, 30, where an unfixed toner image on the copy sheet is fixed, and exhausted to the sheet exhaust tray. In this case, oil application unit O is separated away from a fixing roller 29 while the copy sheet exists at least between the pair of fixing rollers 29, 30 (S5). Then, the above process is repeated by counting the number (S6) until the set number of sheets is reached (S7).

In this embodiment, the oil application unit is always separated away from the fixing roller 29 during the above period. Taking into consideration the life of fixing roller and the safety for offset, it is more preferable that the oil is supplied to each copy sheet by the oil application unit O placed into contact with the fixing roller 29 over one or so rotation of fixing roller at a timing when no copy sheet exists between the pair of fixing rollers 29, 30 during the copying. If the necessary number of sheets are copied, a message "Copy on second surface. Set copy sheet on sheet exhaust tray to cassette, exchange original and depress copy button again." appears on the liquid crystal display 64. If the copy button is depressed again (S10), the count is reset to 1 (S11), and the copy on the second surface is started. Copy sheet on which a full-color image is formed through the same process as previously described is carried and conveyed between a pair of fixing rollers 29, 30, where an unfixed toner image on the copy sheet is fixed, and exhausted to the sheet exhaust tray. In this case, the oil application unit O is placed in contact with the fixing roller 29 while the copy sheet exists at least between the pair of fixing rollers 29, 30 (S12). Then, the above process is repeated until the set number of sheets is reached (S13, S14). If a predetermined number of sheets is reached, the copy is ended.

In the one-side copy, the oil application unit O is placed into contact with the fixing roller (S16 to S19) while the copy sheet exists at least between the pair of fixing rollers 29, 30.

According to this embodiment, it is possible to form stably high quality image over the long term without causing degradation of image due to oil and without producing any wrinkles.

(Embodiment 3)

Figure 9:
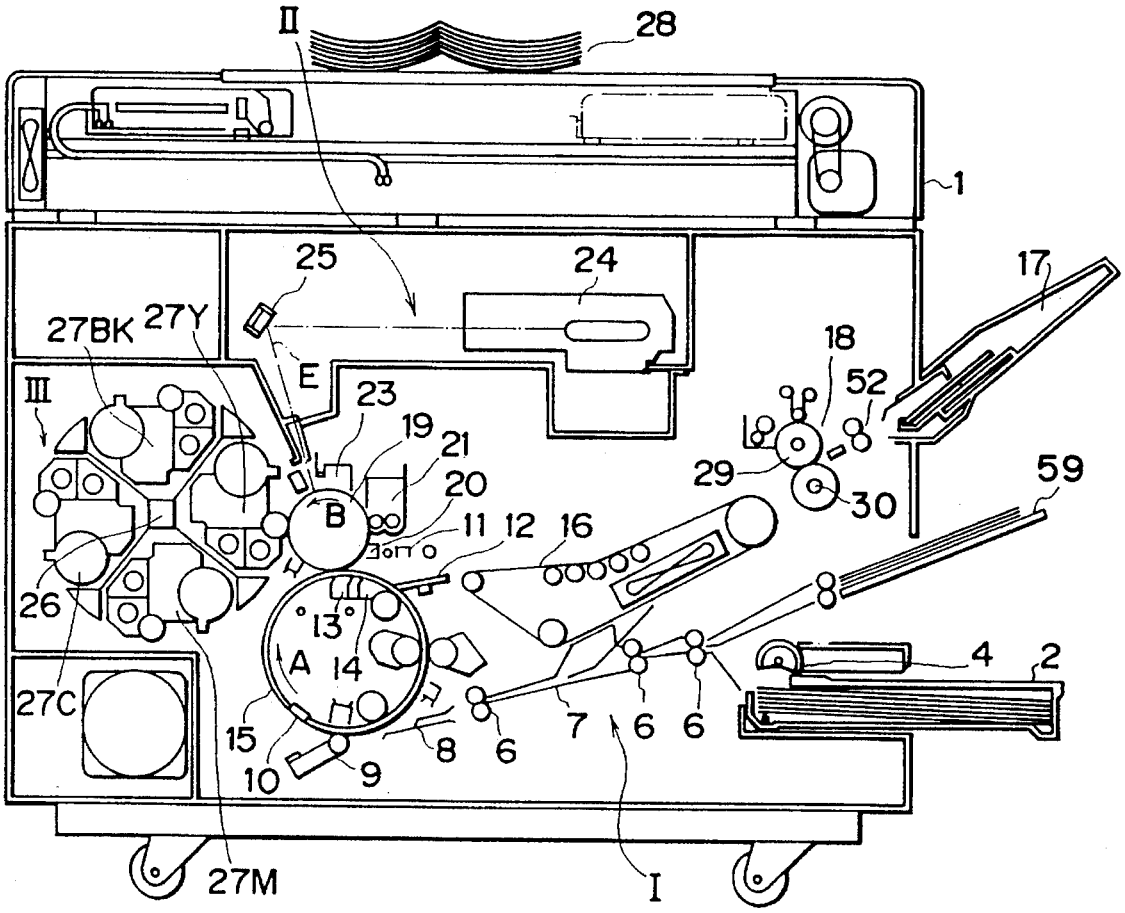
FIG. 9 is a cross-sectional view of an image forming apparatus in another embodiment of the present invention.

A third embodiment of the present invention will be described below with reference to FIGS. 9, 10 and 11.

An apparatus has manual insertion sheet supply means 59 for manually inserting the recording medium. In the apparatus of this embodiment, the copy sheet on the second surface is inserted by hand.

Figure 10:
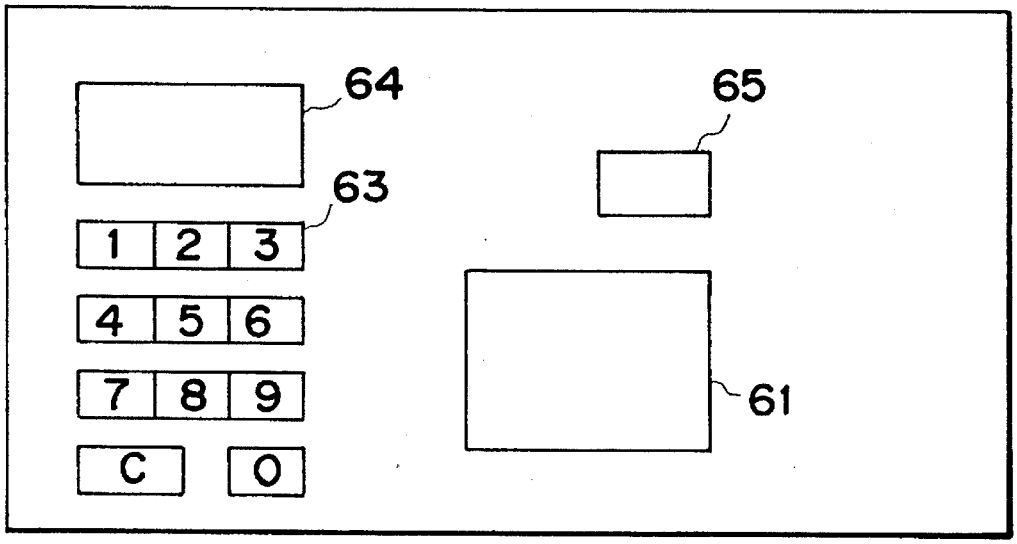
FIG. 10 is a plan view of an operation panel in another embodiment of the present invention.

FIG. 10 simply illustrates a necessary portion on the operation panel. Like parts are indicated by the same numerals as in FIG. 6. Reference numeral 65 as indicated by the same numeral represents a both-face or second surface button.

When copying on the second surface of both sides, the button 65 is depressed.

Figure 11:
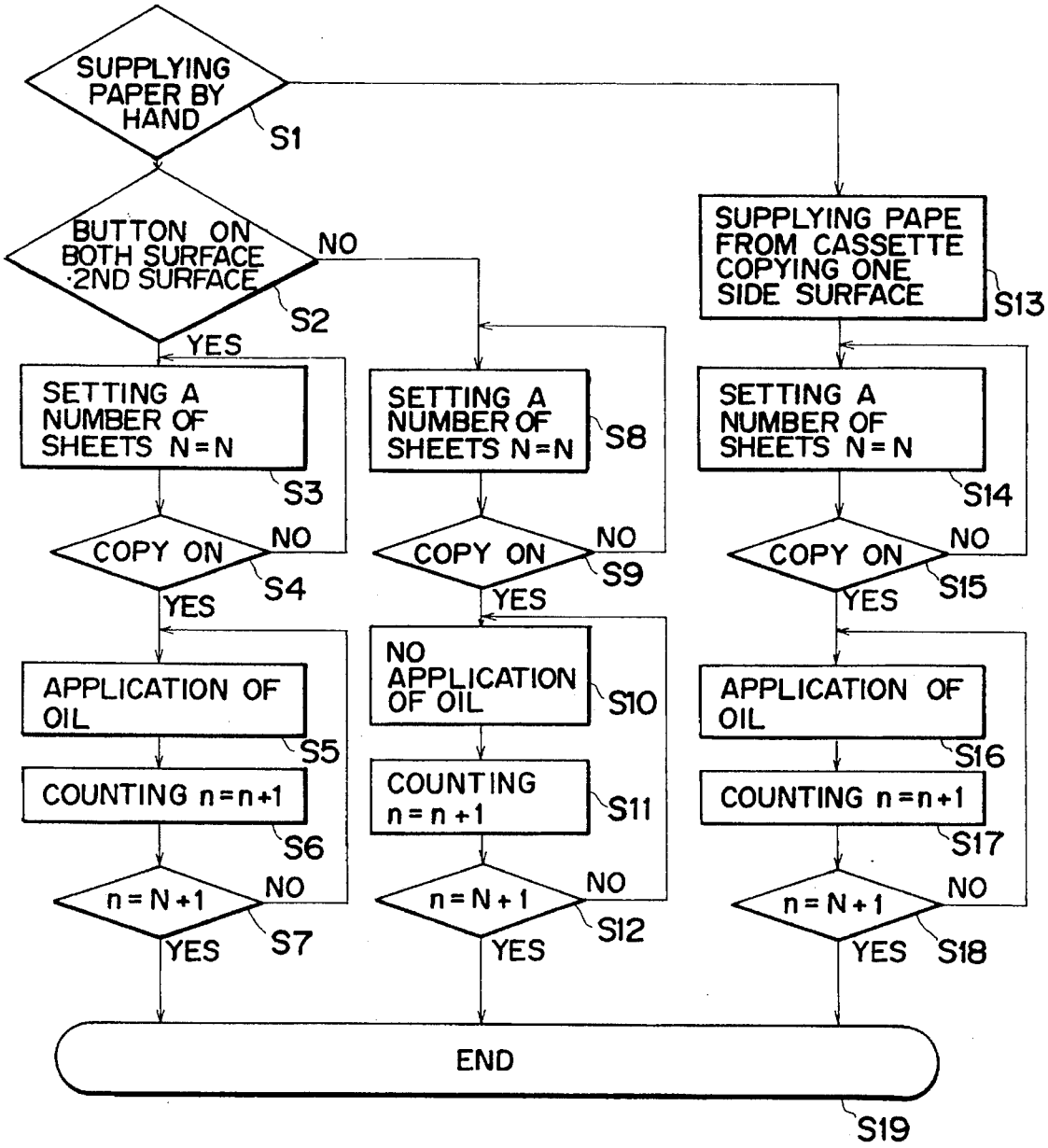
FIG. 11 is a flowchart of another embodiment of the present invention.

FIG. 11 shows a flowchart of this embodiment.

First, a manual insertion mode is determined (S1) while a manual insertion lever (not shown) provided in a manual insertion sheet supply portion is in ON state. If the both-face or second surface button is depressed (S2), the necessary number of sheets to be copied is set (S3). And if the copy button is depressed (S4), the copy is started. Copy sheet on which a full-color image is formed through the same process as previously described is carried and conveyed between the pair of fixing rollers 29, 30, where an unfixed toner image on the copy sheet is fixed, and exhausted to a sheet exhaust tray.

In this case, oil application unit O is placed into contact with a fixing roller 29 to apply the oil on the surface of fixing roller 29 while the copy sheet exists at least between the pair of fixing rollers 29, 30 (S5). Then, the above process is repeated by counting the number (S6), until the set number of sheets is reached (S7). Then, in the manual insertion mode where the both-face or second surface button is not depressed, the necessary number of sheets is set (S8), and if the copy button is depressed (S9), the copy is started.

Copy sheet on which a full-color image is formed through the same process as previously described is carried and conveyed between the pair of fixing rollers 29, 30, where an unfixed toner image on the copy sheet is fixed, and exhausted to the sheet exhaust tray. In this case, the oil application unit O is separated away from the fixing roller 29 while the copy sheet exists at least between the pair of fixing rollers 29, 30 (S10). Then, the above process is repeated by increasing count number by one (S11), until the set number of sheets is reached (S12). In this embodiment, the oil application unit is always separated away from the fixing roller 29 during the above period. Taking into consideration the life of fixing roller and the safety for offset, it is more preferable that the oil is supplied with the oil application unit O being placed into contact with the fixing roller 29 over one or so rotation of fixing roller per one copy sheet at a timing when no copy sheet exists between the pair of fixing rollers 29, 30 during the copying, as in the embodiment 1.

When not in the manual insertion mode (cassette sheet supply mode S13), the number of sheets is set (S14), and if the copy button is depressed (S15), the copy is started. In this case, the oil application unit O is placed into contact with the fixing roller 29 to apply the oil onto the surface of fixing roller 29 while the copy sheet exists at least between the pair of fixing rollers 29, 30 (S16). Then, the above process is repeated by counting the number (S17), until the set number of sheets is reached (S18).

As described above, by limiting the both-face copy to the manual insertion mode, high quality image was stably obtained over the long term without causing degradation of image due to oil and without producing any wrinkles, even with the low cost image forming apparatus.

(Embodiment 4)

Figure 12:
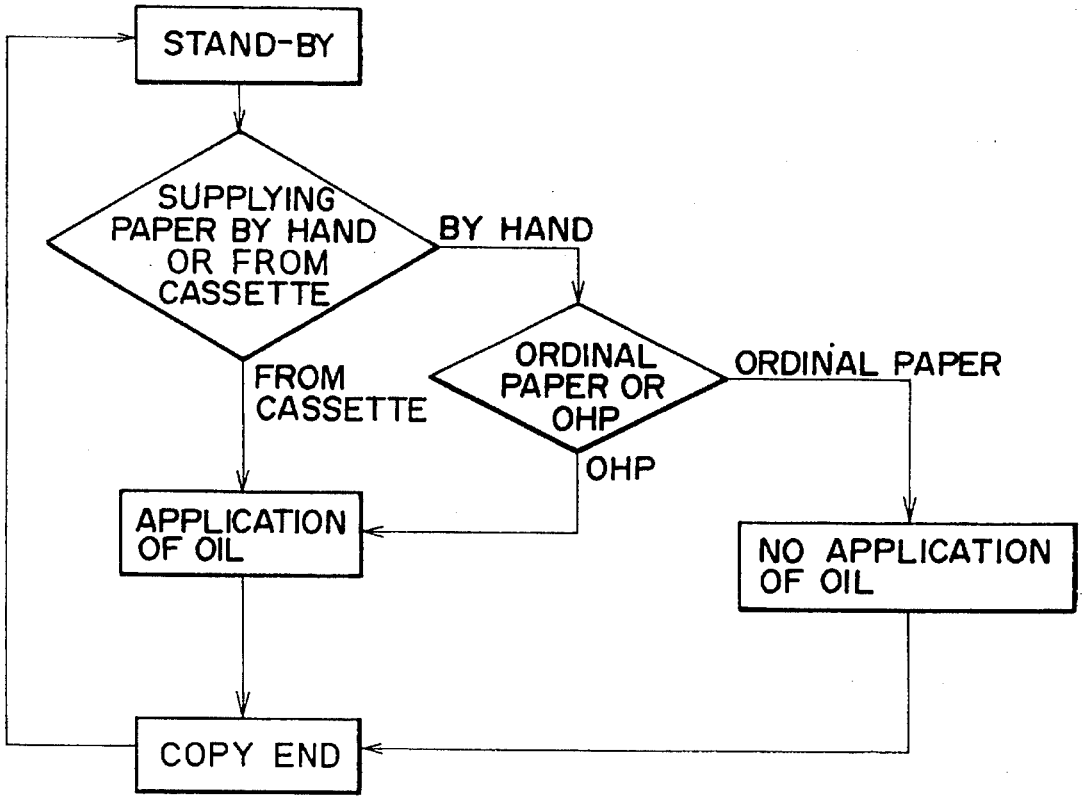
FIG. 12 is a flowchart of another embodiment of the present invention.

FIG. 12 is a flowchart of the fourth embodiment of the present invention. The apparatus constitution is the same as shown in FIG. 9.

In FIG. 12, first, when cassette sheet supply is selected, the oil application is made. If manual insertion sheet supply is selected, it is discriminated whether the recording medium is ordinary paper or OHP with the aid of a discriminant sensor (not shown).

If the recording medium is ordinary paper, no oil application is made, while if it is OHP film, the oil application is made as conventionally.

That is, in this embodiment, the oil application is performed as conventionally except when an ordinary sheet is supplied in the manual insertion sheet supply mode. With such a sequence, formation of image on both surface is permitted only in the manual insertion mode. That is, when forming image on both surface, the sheet must be manually inserted for both the first and second surfaces, and because no oil application is made, there is no problem that any image failure or slip of the sheet supplied may occur.

For the OHP film, the fixing must be made more sufficiently than the ordinary sheet to provide higher transmittance, and the toner is more likely to adhere to the surface of fixing roller due to the fixing at low speed. Also, the OHP film has no image formed on the second surface in any case, and when the OHP film is used in the manual insertion mode, the oil application is made all over the OHP film from the leading edge to the trailing edge thereof, as conventionally performed.

In this way, when in the cassette sheet supply where high frequency of image formation will occur, the OHP film is used, in which the toner is likely to adhere to the fixing roller, the oil application is made as conventionally, resulting in a longer life of fixing roller at all times than when the oil application amount is reduced. Also, when in the manual insertion, the ordinary sheet is supplied, no oil application is made, whereby there will occur no conventional problems by limiting the formation of image on both surface to this instance.

Therefore, it will be understood that the life of fixing roller is not shortened by image formation on both surface.

(Embodiment 5)

Figure 13:
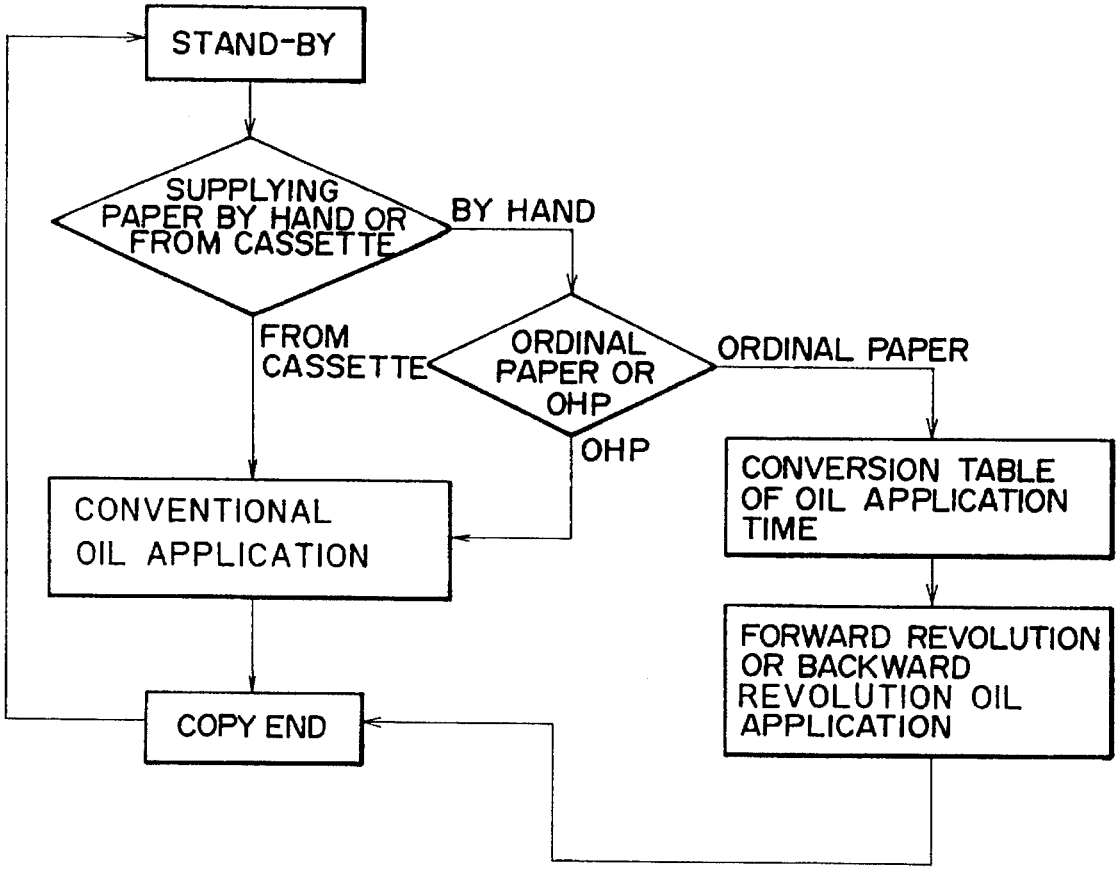
FIG. 13 is a flowchart of another embodiment of the present invention.
Figure 14:
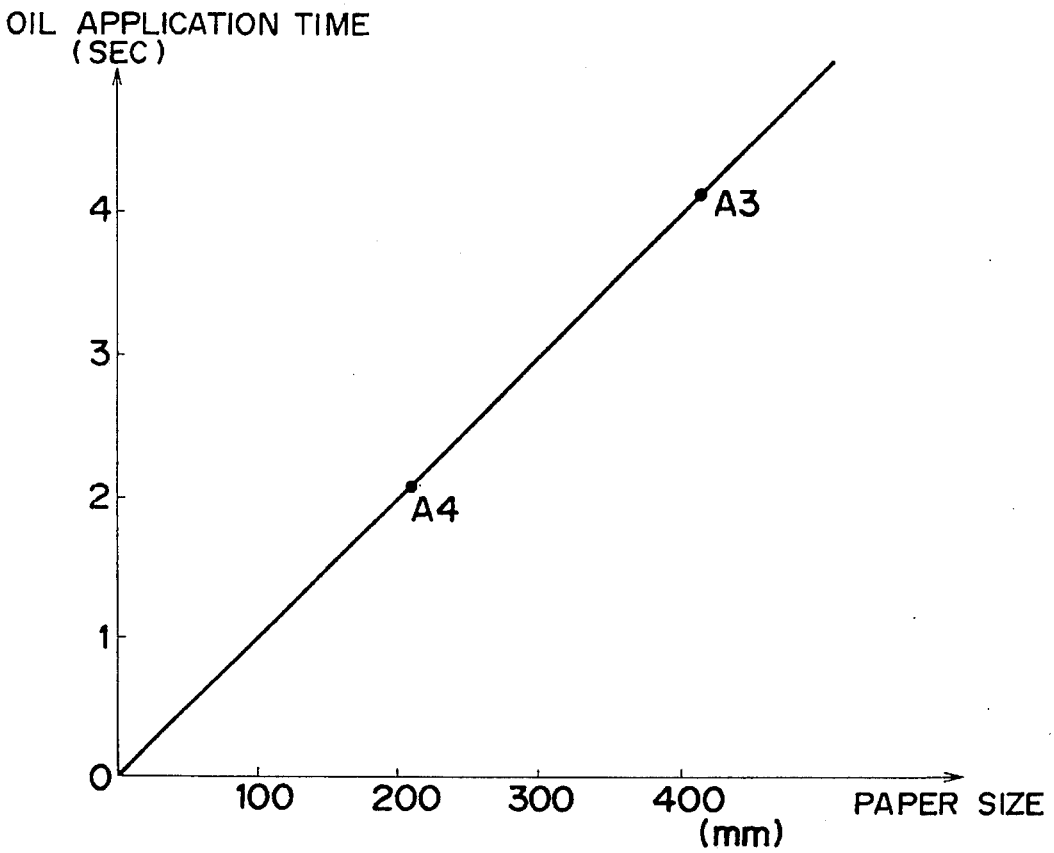
FIG. 14 is a conversion table of release agent application time.

A fifth embodiment of the present invention is illustrated in FIGS. 13 and 14.

FIG. 13 is a flowchart showing the oil application sequence of a fixing unit in this embodiment, and FIG. 14 is a conversion table to determine the oil application time. In this embodiment, unlike the first embodiment, when the ordinary sheet used in the manual insertion mode, oil application is made after the fixing upon the rotation of fixing roller 29 and pressure roller 30 in a forward or backward direction. In FIG. 14, when the OHP sheet is used in the cassette sheet supply and manual insertion sheet supply, normal oil application is made, like the first embodiment.

When the ordinary sheet is supplied in the manual insertion sheet supply mode, no oil application is made at the time of fixing.

In this case, the formation of image on both surface is allowed only in the manual insertion sheet supply mode, like the fourth and fifth embodiments.

However, in practice, when the ordinary sheet is supplied in the manual insertion sheet supply mode, no oil application is made, so that a slight amount of toner will stick to small portion on the surface of fixing roller 29.

This slight amount of sticking toner is cleaned away by cleaning means C, C1, but is unlikely to be released from the fixing roller 29 because of no oil application, which is undesirable for the life of fixing roller 29 and pressure roller 30.

In this embodiment, oil application is made before and after the fixing to allow for the easy release of the slight amount of toner sticking to the surface of roller when the fixing is performed, or to immerse the oil into the surface layer of fixing roller 29 and pressure roller 30 before the actual fixing to enhance the effect of releasing even if oil application is not made when the fixing is performed.

In this case, the oil application time is more effectively determined by using a conversion table as shown in FIG. 3. In this embodiment, this oil application time (oil application amount) is determined depending on the size of recording medium. That is, since the amount of toner attached onto the surface of the fixing roller 29 will more likely increase with larger size, the oil application time is determined according to the time for which the recording medium passes through a fixing nip portion. FIG. 3 illustrates the oil application time relative to the size of recording medium when the fixing rate is 100 mm/sec, wherein the oil application is set according to the time for which the leading edge of recording sheet enters into the fixing nip and the trailing edge exits therefrom. For example, the time required when the recording sheet of A4 size (210×297 mm) passes through the nip portion at a fixing rate of 100 mm/sec is 2.1 seconds, while in the A3 size (420×297 mm), the oil application time is 4.2 seconds.

With the above, when the OHP film is used in the cassette sheet supply or manual insertion sheet supply mode, the oil application is made as conventionally, and only when the ordinary sheet is used in the manual insertion sheet supply mode, the oil application is made in the forward or backward rotation of the fixing roller, whereby conventional problems can be eliminated by limiting the formation of image on both surface to the manual insertion sheet supply mode.

Also, when the ordinary sheet is used in the manual insertion sheet supply mode, oil application is not made to the portion in contact with the recording medium, but only made in accordance with the size of recording medium in the forward or backward rotation, whereby the life of fixing roller can be improved as compared with the embodiment 4.

(Embodiment 6)

Figure 15:
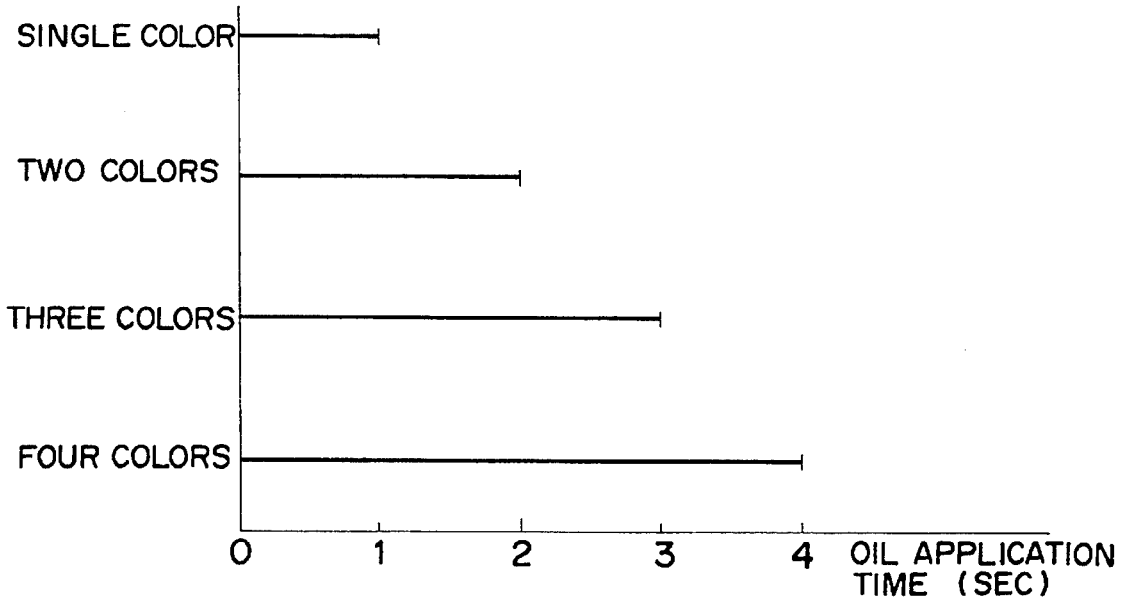
FIG. 15 is a conversion table of release agent application time.

A sixth embodiment of the present invention is illustrated in FIGS. 13 and 15. FIG. 15 is a conversion table of oil application time.

The oil application time conversion table as illustrated in FIG. 15 has the oil application time set in accordance with the image formation mode (single color image, two-color image, three-color image, four-color image). If the amount of toner used for image formation increases, the amount of toner attached to the surface of fixing roller also increases.

In this embodiment, when the ordinary sheet is supplied by manual insertion, oil application is made in the forward or backward rotation, and the oil application time is set to be longer with greater use amount of toner in the image formation mode. In this embodiment, supposing that the oil application time is 1 in the formation of single color image, the oil application time is lengthened to two, three or four times the value 1 for two-color image, three-color image, or four-color image, respectively.

(Embodiment 7)

A seventh embodiment of the present invention is illustrated in FIGS. 13., 16 and 17.

In this embodiment, the output level of digital image signal for each pixel is added when copying on the video count system to control the oil application time.

Figure 16:
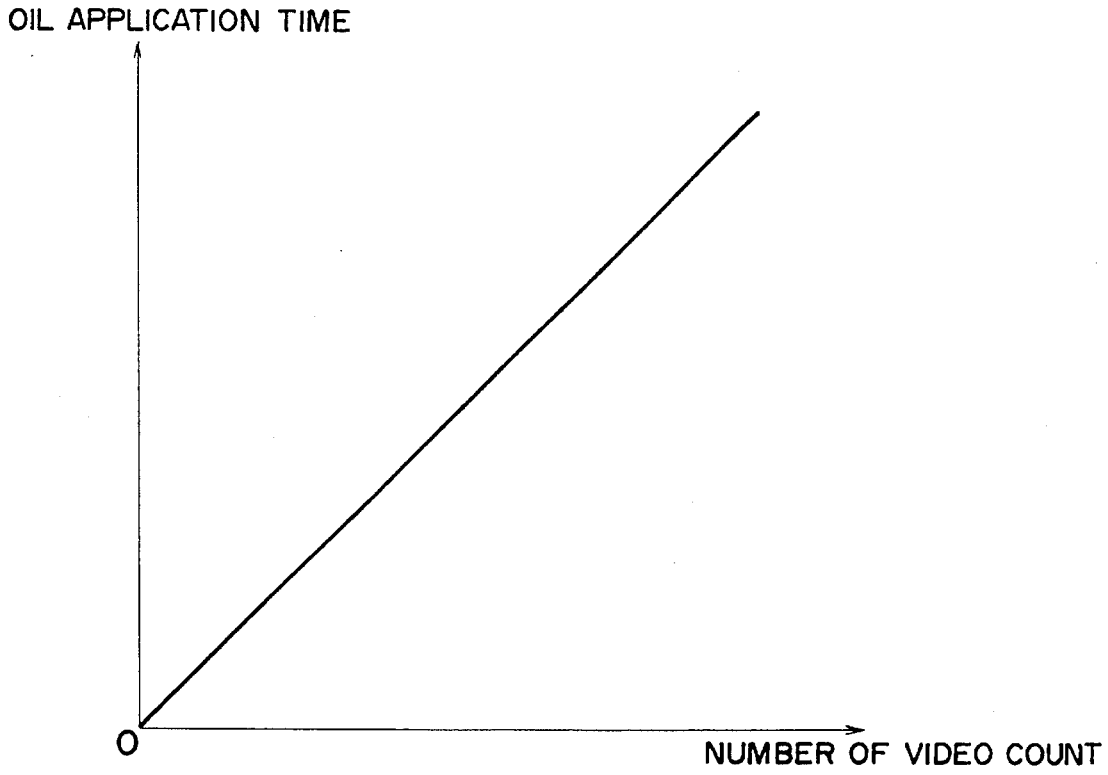
FIG. 16 is a conversion table of release agent application time.
Figure 17:
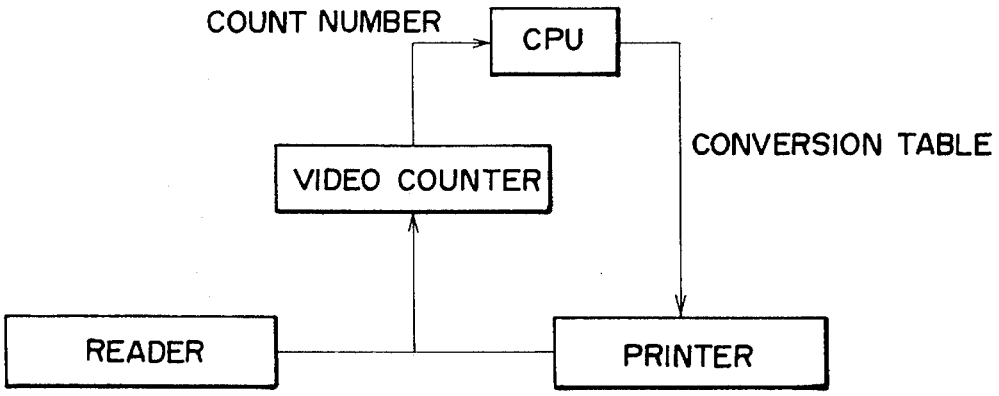
FIG. 17 is a block diagram of another embodiment of the present invention.

FIG. 17 is a diagram illustrating the schematic configuration of this embodiment, wherein the input image signal is A/D converted from a reader, and the output level of digital signal for each pixel is added to obtain the video count number. The oil application time is determined in accordance with the video count, as shown in FIG. 16. That is, with larger quantity of image information and greater amount of toner necessary for the image formation, the oil application time is longer, or conversely with the smaller quantity of image information, the oil application time is shortened.

In this embodiment, the oil application time is determined in accordance with the quantity of image information only if the ordinary sheet is used in the manual insertion sheet supply mode, as shown in FIG. 13, and the oil application is made when no recording medium exists at the fixing nip portion. By doing so, when the OHP film is used in the cassette sheet supply or manual insertion sheet supply mode, oil application is made as conventionally, and only when the ordinary sheet is used in the manual insertion sheet supply mode, oil application is made in the forward or backward rotation, whereby conventional programs can be eliminated by limiting the formation of image on both surface to the manual insertion.

Also, when the ordinary sheet is used in the manual insertion sheet supply mode, oil application is not made to the portion of fixing roller in contact with the recording medium, but is made in accordance with the quantity of image information in the forward or backward rotation, whereby the life of fixing roller is improved. In this embodiment, the oil application time is set in accordance with the quantity of image information, but is not limited thereto.

Then, the amount of oil to be applied will be described below.

The amount of applying oil on the second surface of both sides is preferably 20 mg/A4 or more.

This amount will provide sufficient slip effect and prevent any wrinkles of recording sheet from arising in the both surfaces.

On the contrary, the amount of applying oil on the first surface of both sides is preferably 1 mg/A4 or less, or more preferably 0.1 mg/A4 or less to prevent any image failure due to the transition of oil to the photosensitive member.

Also, the difference in oil application amount on the first and second surface of both sides is such that the oil application amount on second surface is twenty times or more that on the first surface, or more preferably 200 times or more.

(Embodiment 8)

Figure 18:
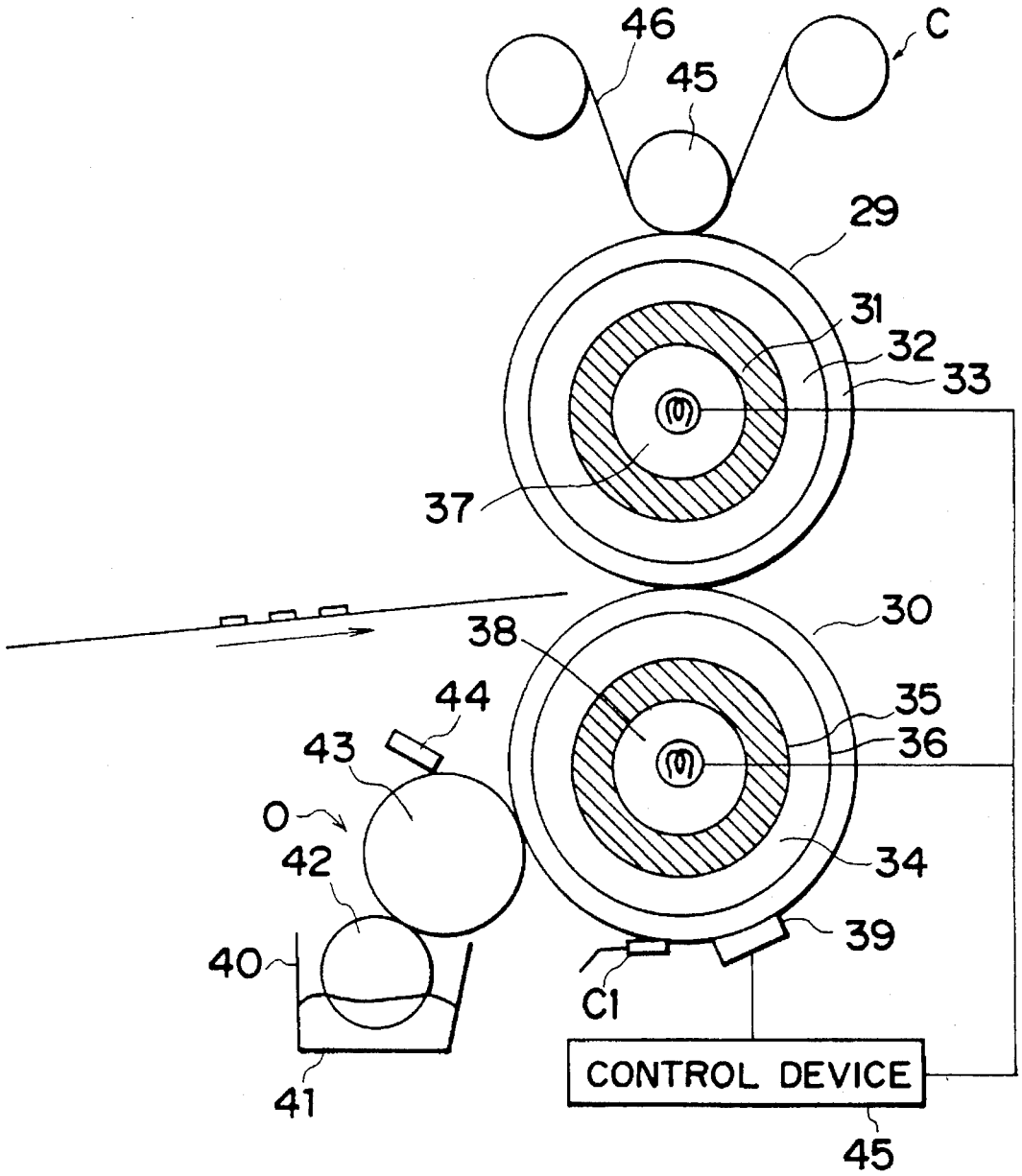
FIG. 18 is a cross-sectional view of a fixing unit for use in another embodiment of the present invention.

A fixing unit according to another embodiment of the present invention is illustrated in FIG. 18.

In this embodiment, oil is applied by an oil application unit O to a pressure roller 30 as fixing rotation member.

However, it is more preferable that oil is applied to a fixing roller in view of the offset prevention effect when fixing onto a number of sheets continuously.

(Embodiment 9)

Figure 19:
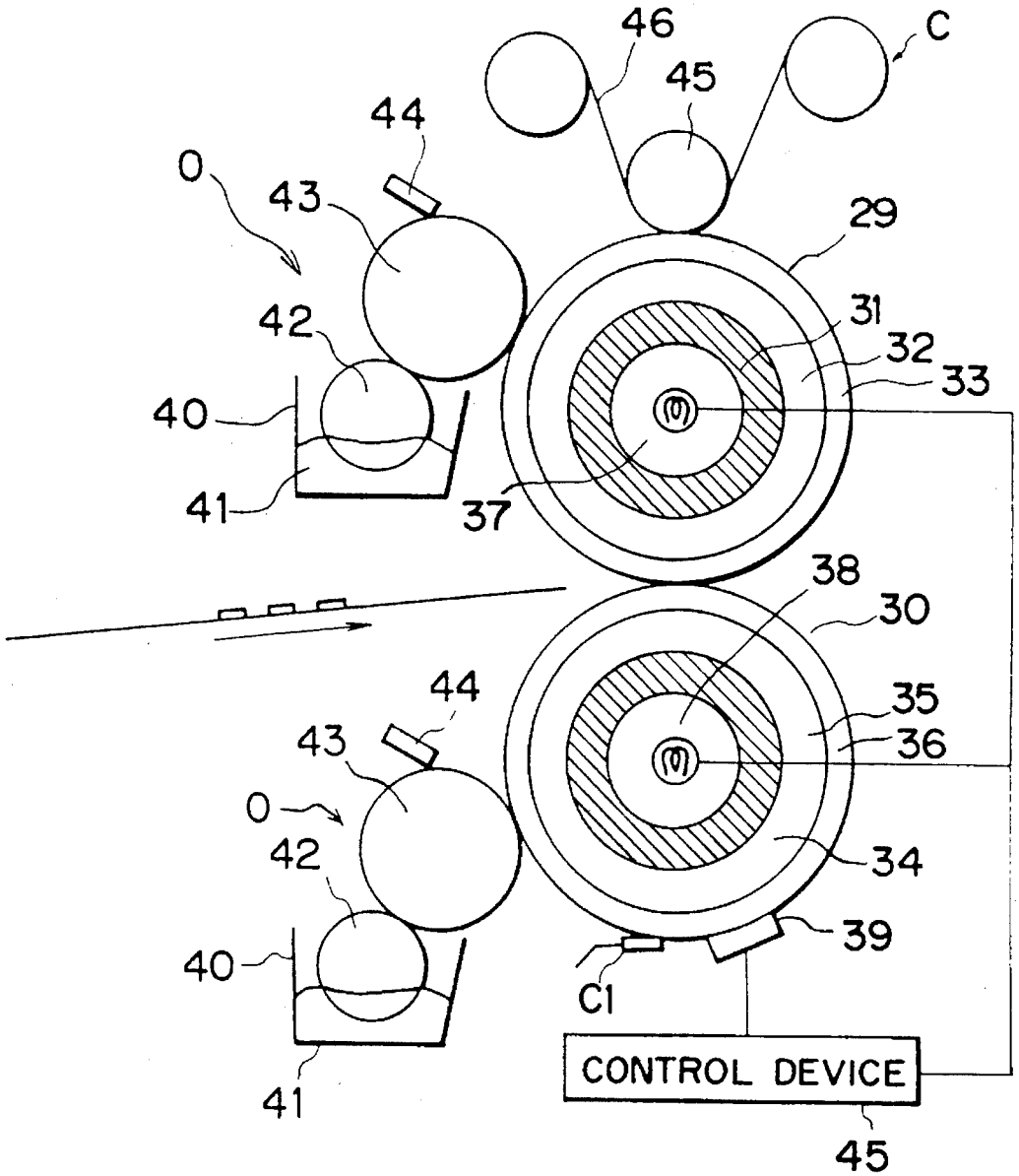
FIG. 19 is a cross-sectional view of a fixing unit for use in another embodiment of the present invention.

A fixing unit according to another embodiment of the present invention is illustrated in FIG. 19.

In this embodiment, oil application units Oa, Ob are provided in fixing and pressure rollers, respectively, but the oil application unit Oa suffices to effect normal fixing on the first surface. However, this is a preferable form because not only the fixing roller 29 but also the pressure roller 30 are given improved slip property to the effect of preventing wrinkles on the second surface. An oil application unit on the pressure roller side is not required to have good precision in the evenness of applied oil because it is provided for the slip effect, for which a simpler method of application with felt or pad, but not roller, may be used. Also, since the pressure roller side is in contact with the image already fixed, silicone oil having a high releasing effect is not particularly used, but a solid bar-like wax which will liquefy at the temperature of pressure roller may be alternatively used by pressing without causing any problem.

(Embodiment 10)

While in the foregoing embodiments the oil application amount was changed depending on the first and second surfaces, an embodiment of changing the kind of oil will be described below.

The fixing on the first surface is made using an oil having an oil viscosity of 100 cs or less, or preferably 50 cs or less. In this case, the substantial oil application amount is not only reduced because the oil viscosity is set low, but also the use of low viscous oil allows for the reduction of fog due to attachment of oil onto the photosensitive drum. Then, an oil 54 is used for the fixing on the second surface. This oil is required in greater amount than on the first surface, in order to assure the releasing ability in the fixing as well as the slip ability at the nip portion between the fixing and pressure rollers. For this purpose, when the oil application speed is equal for the first and second surfaces, it is necessary to raise the oil viscosity, and increase the oil application amount using silicone oil of 150 cs or more, or preferably 250 cs or more. However, when using the oil of 1000 cs or more, the application oil amount is excessive so as to cause oil stain on the sheet, and therefore must be determined appropriately.

(Embodiment 11)

In the foregoing embodiments, the amount of release agent applied onto the fixing roller or pressure roller, and its kind, were changed depending on the first and second surfaces, but in order to assure the slip at the nip portion with the sheet on the second surface, means for spraying powder wax liquefying by heating of the fixing over the sheet may be appended to the fixing unit immediately before entering the fixing unit to apply such wax on the sheet before fixing on the second surface.

While the embodiments of the present invention have been described, the present invention is not limited to such embodiments, but various variations may be made within the technical concepts of the invention.

What is claimed is:

1. An image forming apparatus capable of forming an image on both surfaces of a recording medium having a first surface and a second surface, comprising:

image forming means for forming an unfixed image on an image carrier;

transfer means for transferring said unfixed image on said image carrier to the recording medium, said transfer means having a transfer rotor rotating with the recording medium carried thereon;

a fixing rotor for fixing said unfixed image on the recording medium at least under application of pressure;

application means attachable to and detachable from said fixing rotor and for applying a release agent onto said fixing rotor; and cleaning means for cleaning a surface of said fixing rotor;

wherein when fixing is performed on the first surface of said recording medium, said application means is released from said fixing rotor and said cleaning means cleans the surface of said fixing rotor.

2. An image forming apparatus according to claim 1, wherein said application means does not apply the release agent onto at least a portion of said fixing rotor corresponding to the recording medium upon fixing on the first surface of the recording medium, but applies the release agent upon fixing on the second surface of the recording medium.

3. An image forming apparatus according to claim 1, wherein an amount of the release agent applied onto said fixing rotor upon fixing on the second surface is greater than that applied upon fixing on the first surface.

4. An image forming apparatus according to claim 1, wherein the recording medium on said transfer rotor has an unfixed image composed of a plurality of colors electrostatically laminated, said fixing rotor mixing in colors and fixing the unfixed image composed of the plurality of colors.

5. An image forming apparatus comprising:

cassette sheet supply means for supplying a recording medium from a cassette;

manual insertion sheet supply means for supplying the recording medium by manual insertion;

image forming means for forming an unfixed image on the recording medium supplied;

a fixing rotor for fixing the unfixed image on the recording medium at least under application of pressure; and application means for applying a release agent onto said fixing rotor;

wherein the release agent applied by said application means in a cassette sheet supply mode is different in quantity or kind from that in a manual insertion sheet supply mode.

6. An image forming apparatus according to claim 5, wherein said application means does not apply the release agent onto at least a portion of said fixing rotor corresponding to the recording medium in the manual insertion sheet supply mode, but applies the release agent in the cassette sheet supply mode.

7. An image forming apparatus according to claim 5, wherein an amount of the release agent applied in the cassette sheet supply mode is greater than that applied in the manual insertion sheet supply mode.

8. An image forming apparatus according to claim 5, wherein said image forming means laminates an unfixed image composed of a plurality of colors on the recording medium, said fixing rotor mixing in colors and fixing the unfixed image composed of the plurality of colors.

9. An image forming apparatus comprising:

image forming means for forming an unfixed image on a recording medium;

a fixing rotor for fixing the unfixed image on the recording medium at least under application of pressure; and application means for applying a release agent onto said fixing rotor;

wherein said application means applied the release agent over one or more rotation except for timing at which said fixing rotor makes contact with the recording medium.

10. An image forming apparatus according to claim 9, wherein said image forming means has an image carrier for carrying the unfixed image and a rotor for making contact with the recording medium and the image carrier.

11. An image forming apparatus according to claim 9, wherein said fixing rotor has a surface layer composed of silicone rubber, the release agent being a silicone oil.

12. An image forming apparatus capable of forming an image on both surfaces of a recording medium, comprising:

image forming means for forming an unfixed image on an image carrier;

transfer means for transferring said unfixed image on said image carrier to the recording medium, said transfer means having a transfer rotor rotating with the recording medium carried thereon;

a fixing rotor for fixing said unfixed image on the recording medium at least under application of pressure; and application means for applying a release agent onto said fixing rotor;

wherein the release agent applied by said application means upon fixing on the first surface is different in kind from the release agent applied upon fixing on the second surface.

* * * * *

UNITED STATES PATENT AND TRADEMARK OFFICE

CERTIFICATE OF CORRECTION

PATENT NO. : 5,563,695
DATED : October 8, 1996
INVENTOR(S) : SAKURAI et al.

It is certified that error appears in the above-indentified patent and that said Letters Patent is hereby corrected as shown below:

Drawings:

FIG. 11

Change "SUPPLYING PAPE" (S13) to --SUPPLYING PAPER--.

COLUMN 4

Line 16, change "having a slight convex" to --being slightly convex-- ;

COLUMN 10

Line 65, change "or so rotation" to --or more rotations--.

COLUMN 11

Line 30, change "surface" to --surfaces--;
Line 32, change "image on both surface" to --images on both surfaces--;
Line 64, change "sheet used" to --sheet is used--.

COLUMN 12

Line 12, change "to small" should read --to a small--;
Line 50, change "image" to --images--;
Line 51, change "surface" to --surfaces--.

Signed and Sealed this
Sixth Day of May, 1997

Bruce Lehman

*Attest:*

*Attesting Officer*

BRUCE LEHMAN

*Commissioner of Patents and Trademarks*